United States Patent [19]

Szegvari et al.

[11] Patent Number: 4,979,686

[45] Date of Patent: Dec. 25, 1990

[54] HIGH SPEED DRY GRINDER

[75] Inventors: Arno Szegvari; Margaret Y. Szegvari, both of Akron; Arden L. Just, Kent, all of Ohio

[73] Assignee: Union Process, Inc., Akron, Ohio

[21] Appl. No.: 416,653

[22] Filed: Oct. 3, 1989

[51] Int. Cl.[5] ..... B02C 17/16

[52] U.S. Cl. ..... 241/172; 241/180; 241/285 A

[58] Field of Search ..... 241/172, 173, 174, 179, 241/180, 285 A

[56] References Cited

U.S. PATENT DOCUMENTS

| | | | |
|---|---|---|---|
| 3,215,353 | 11/1965 | Goeser | 241/172 X |
| 3,601,322 | 8/1971 | Szegvari | 241/172 X |
| 3,770,214 | 11/1973 | Gabor | 241/172 X |
| 4,244,531 | 10/1981 | Szegvari | 241/172 |
| 4,739,938 | 4/1988 | Ishikawa et al. | 241/172 X |

OTHER PUBLICATIONS

*Laboratory Attritors,* Union Process, ©1988.
*Production Attritors,* Union Process, ©1989.
*HSF Batch Bead Mill,* Union Process, ©1989.
*Turbamill TM,* Union Process, ©1988.

*Primary Examiner*—Timothy V. Eley
*Attorney, Agent, or Firm*—Reese Taylor

[57] ABSTRACT

A continuous dry grinder for grinding particulate material with the assistance of grinding elements includes a comminuting vessel which contains the grinding elements and receives material to be ground through an upper feed chute and discharges the ground material through a radially mounted screen, valve and discharge chute. A motor driven agitator assembly is disposed within the vessel and includes alternating radially projected agitating arms and diverter discs mounted on a rotating agitator shaft. The agitating arms are L-shaped and have their short legs alternately projecting toward the top and bottom of the vessel.

24 Claims, 4 Drawing Sheets

HIGH SPEED DRY GRINDER

BACKGROUND OF THE INVENTION

This invention relates in general to the production of fine homogeneous powders with a very narrow particle size distribution from particulate solids in a stirred ball mill or agitated-media grinder and relates in particular to a high speed, continuous apparatus for processing particulate solids into such fine powder by a dry, continuous process with radial discharge.

DESCRIPTION OF THE PRIOR ART

The prior art includes various methods and apparatus for dry grinding particulate solids including ball mills, vibratory mills, impact mills, jet mills, pin mills, hammer mills and tube mills, all of which are well-known in the art.

More particularly, the prior art includes agitated-media devices or stirred ball mills. In that regard, these mills utilize a method wherein the material to be ground is mixed with grinding elements or balls and agitated.

Such comminuting means generally include a vessel that contains a bed of comminuting or grinding elements that are agitated by members connected to a rotating shaft.

A substantial advantage of the agitated media type comminuting mills, as compared to vibratory mills or ball mills for example, is that comminution occurs primarily between the comminuting elements of the agitated media and does not involve the vessel walls. Consequently, mechanical wear on the inner wall of the vessel is considerably reduced. Still another advantage of agitated-media type comminuting mills is that the comminuting vessel remains stationary so that these mills are less cumbersome.

Devices of this general type have utility in a variety of industries, such as the chemical, agricultural, rubber, ceramic, paper coating, metal, powder, paint and varnish, printing, pharmaceutical, cosmetic, plastic, electronic and confectionery industries.

The basic objective of these devices is to provide a constant flow of generally uniformly and finely ground processed material. Typically, the solid particles are ground, in the prior art, to a particle size in the range of 100 to 5 microns.

As mentioned, the material to be ground is placed in the stationary tank or vessel with suitable grinding media, such as carbon steel, stainless steel, chrome steel, tungsten carbide or ceramic type balls ranging generally from 3/16 of an inch to ½ of an inch in diameter. This media is set forth as illustrative only and is well-known in the industry.

In a batch-type dry process, a selected quantity of a process mixture is placed in a vessel together with the comminuting or grinding media elements and the grinding media is then agitated by an agitator following which the batch is removed and the process is repeated.

In the continuous dry grinding process, the material is fed into the vessel at the top, falls through the grinding media bed, and is discharged through grids at the bottom.

These various approaches to the grinding operation have both advantages and disadvantages. For example, with batch-type operations, there is a requirement for stopping the grinding operation for discharge, while this is not required in a continuous system. However, in a continuous dry system, the discharge is generally by gravity which is unsuitable with extremely finely ground material or material having low density.

Therefore, while each of the aforementioned approaches have been found to be satisfactory in the appropriate situation, it is believed that the basic concept can be improved upon by providing a unique new, high speed dry grinder which is also capable of continuous operation.

SUMMARY OF THE INVENTION

It has been found that by utilizing a combination of L-shaped agitating arms and diverter discs on the agitator shaft that continuous dry grinding with side discharge can be achieved.

It is, therefore, a principal object of the invention to provide an improved grinder capable of continuous high speed operation, having a side or radial discharge, using smaller grinding media and capable of operating at relatively high tip speeds.

It has been found that this object can be achieved by arranging the L-shaped agitator arms in alternating arrangement with the diverter discs and with the short legs of the arms alternately directed toward the top and bottom of the vessel.

It has further been found that the desired objects of the invention can be further enhanced by spacing the short legs of the agitating arms from the walls of the vessel from about four to about seven diameters of the grinding elements and by spacing the long leg of the lowermost agitating arm a similar distance from the bottom of the vessel.

It has further been found that the desired objects of the invention can be further enhanced by providing the diverter discs with a diameter of from fifty percent (50%) to about eighty-three percent (83%) of the vessel diameter.

It has further been found that the desired objects of the invention can be further enhanced in some circumstances by providing for a flow of air to be directed into the vessel adjacent the point of radial discharge to facilitate discharge.

It has further been found that the desired objects of the invention can be further enhanced in some circumstances by directing the short legs of some of the uppermost agitating arms toward the top of the vessel.

Accordingly, production of an improved high speed dry grinder of the type described above becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
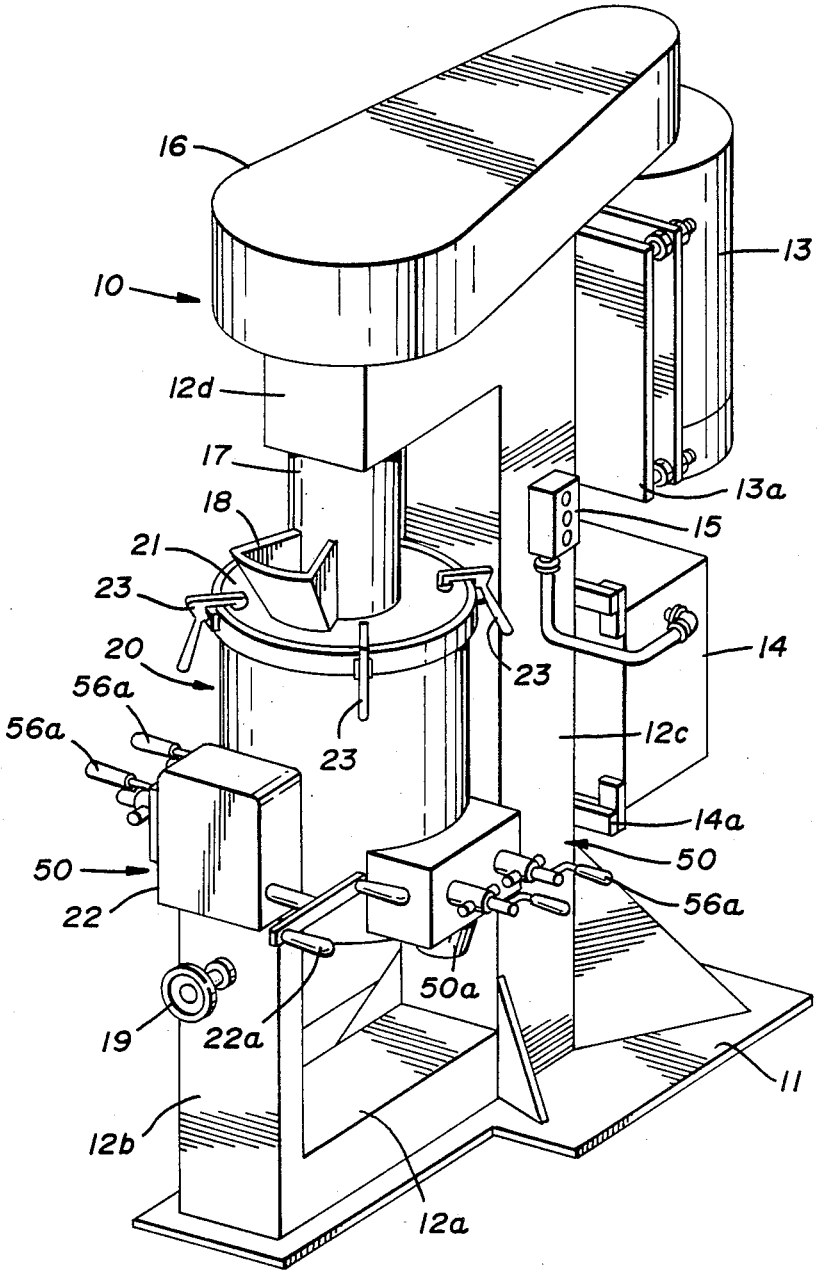
FIG. 1 is a perspective view of one form of the improved high speed dry grinder.

Referring first to FIG. 1 of the drawings, it will be seen that the high speed dry grinder of the present invention, generally indicated by the numeral 10, includes a floor support plate 11 upon which is mounted a machine frame 12, with the machine frame 12 consisting essentially of a horizontal base member 12*a* and opposed vertical legs 12*b* and 12*c* which are either integral with or welded to horizontal base member 12*a*.

The vertical leg 12*b* projects upwardly only a portion of the overall heighth of the machine and serves as support for pivotal mounting of the comminuting vessel, as will be described. The opposed vertical leg 12*c* also extends upwardly from horizontal base member 12*a* and terminates in a horizontally disposed cross arm 12*d* so that the combination of leg 12*c* and cross arm 12*d* resembles an inverted L.

Mounted on one surface of the vertical leg 12*c* is a motor 13 and a mounting plate 13*a* therefor and a starter 14 and a mounting plate 14*a* therefor. The usual push-button controls 15 are also included on one face of leg 12*c* and mounted on the top of the leg 12*d* is a pulley and belt mechanism (not shown) which is attached to the motor 13 in conventional fashion to serve as a drive train for the agitator apparatus, together with a pulley and belt guard 16 covering the same for safety purposes.

The structure just described has not been described or illustrated in great detail, since it is, to some extent, well-known in the art. Suffice it to say that motor 13, when actuated by starter 14, will drive the belt and pulley mechanism to impart rotary motion to the agitator shaft through an appropriate coupling and bearing for purposes which will be described. This mechanical connection and its operation are well-known. Similarly, the electronics and the control circuitry, etc., are believed to be such that one with ordinary skill in this art would be capable of replicating the same without undue experimentation.

Still referring then to FIG. 1 of the drawings for a further description of the improved grinder 10, it will be noted that a comminuting vessel 20 is mounted, for selective pivotal movement, to the legs 12*b* and 12*c* so that, is desired, the entire vessel can be pivoted for access to the interior thereof for cleaning, repair, etc. In the drawings, only the pivot mounting assembly 22, on leg 12*b*, is illustrated, together with operating handle 22*a* which is connected to a worm and gear with a shaft and trunnion connected to vessel 20. It will be understood that a similar shaft and trunnion attachment connects vessel 20 with respect to leg 12*c*. It should also be noted here, however, that the vessel 20 is intended to be locked in a stationary condition during grinding and, to that end, a vessel locking handle 19 can be seen in FIG. 1.

The comminuting vessel 20 also has a removable lid 21 which is secured by clamps 23,23 to the body of the vessel and, adjacent its lower end, one or more discharge valve assemblies 50 are mounted on the wall of the vessel.

Projecting upwardly from the top of the lid 21 is a shaft guard cover 17 which, for safety purposes, covers the agitator shaft and shaft coupling of the agitator assembly which will be described in detail below. A feed chute 18 is also mounted on the top of the lid 21 which has a suitable aperture so that the unground material may be deposited through the chute 18 into the vessel 20.

Figure 2:
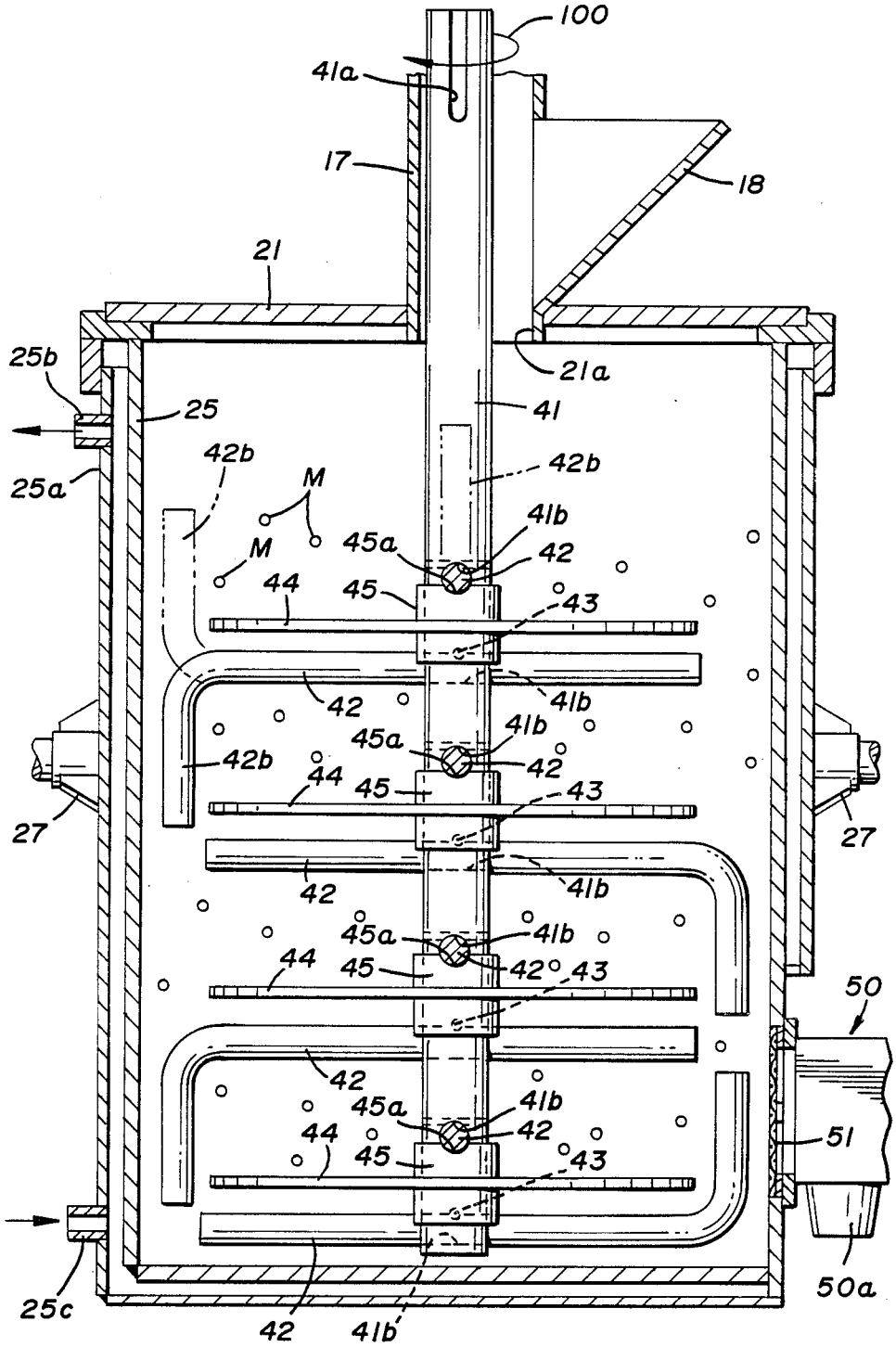
FIG. 2 is an elevational sectional view of the comminuting vessel.

Turning then to FIG. 2 of the drawings, it will be noted that the comminuting vessel 20 includes a body 24 having an inner cylindrical side wall 25 and a bottom wall 26. As illustrated, the body is double walled as at 25*a* and 26*a* so that cooling water may be introduced into the cavity thus formed through inlet and outlet ports 25*b* and 25*c*. Also mounted about midpoint on outer wall 25*a* are trunnions 27,27 for the pivotal mounting of the vessel 20 on legs 12*b* and 12*c*, as has been previously mentioned.

The lid 21 previously referred to is, of course, received on the open end thereof and secured by clamps 23 and has a through opening 21*a* for receipt of the agitator shaft 41 of the agitator assembly 40, as well as the just described opening in communication with feed chute 18. The shaft 41 has one end projecting above the lid 21 and has a keyway 41*a* machined therein. This end of the shaft will be connected to a coupling which also is connected to the shaft and bearing of the pulley which is, in turn, connected to the motor 13, as previously described with regard to FIG. 1 of the drawings, so that shaft 41 may be rotated in the direction of arrow 100. No further detail will be illustrated or described, since such a connection is believed to be well-known in the art.

Grinding media or elements M are contained within vessel 20 and agitated for grinding purposes by the agitator assembly which will now be described.

The agitator shaft 41 has a series of radially extending through bores 41*b*,41*b* arranged in series along the longitudinal axis of shaft 41 and alternately arranged at 90° radial angles for receipt of the agitating arms 42.

Figure 3:
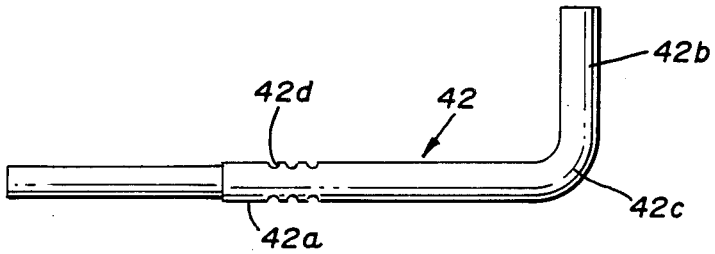
FIG. 3 is an elevational view of one of the L-shaped agitating arms received and used within the comminuting vessel.

Referring to FIGS. 2 and 3, it will be seen that each agitating arm 42 is L-shaped, having a long leg 42*a* and a short leg 42*b* joined thereto by a radiused portion 42*c* and projecting at substantially 90° therefrom. The long leg 42*a* also has one or more milled annular slots 42*d*,42*d* at about its longitudinal midpoint. As can be seen from FIG. 2 of the drawings, these agitating arms 42 are inserted through the bores 41*b*,41*b* and held in place by the pins 43 which are received in the milled slots 42*d*,42*d*. The provision of a plurality of notches 42*d* will make it readily apparent that the mixing arms 42 can be mounted and disposed so that the right angle legs 42*b* thereof can be extended toward the inner side wall 25 or away therefrom, as desired and as required for the particular grinding operation to be performed. As can also be seen from FIG. 3, it is possible to provide for a portion of long leg 42*a* to be of reduced diameter to facilitate insertion and removal of agitating arms 42.

Also mounted on the agitator shaft 41 are a series of diverter discs 44. These diverter discs each have a central aperture so that they may be slid onto the shaft 41, and they are disposed, as clearly apparent from FIG. 2 of the drawings, in alternating relationship with regard to each pair of the L-shaped arms 42. These diverter discs are held in place on the shaft against axial movement by a series of saddle sleeves 45 disposed axially above and below each disc 44 and having radiused notches 45*a* to fit about agitating arms 42.

As previously noted, this device is intended to operate at high speeds and, while it may be characterized as being of the "dry" variety of grinding devices, as set forth above, the discharge will be continuous and to the side, contrary to the normal bottom discharge found in dry grinding, by virtue of the centrifugal force imparted to the ground material. To that end, the lower, right-hand corner of FIG. 2 illustrates the screen 51 through which the ground material will pass to valve assembly 50 and discharge chute 50*a*, and FIGS. 4 and 5 of the drawings illustrate the valving mechanism employed in cooperation with the screen 51. In that regard, various types of screens having various types and sizes of openings can be employed.

Figure 4:
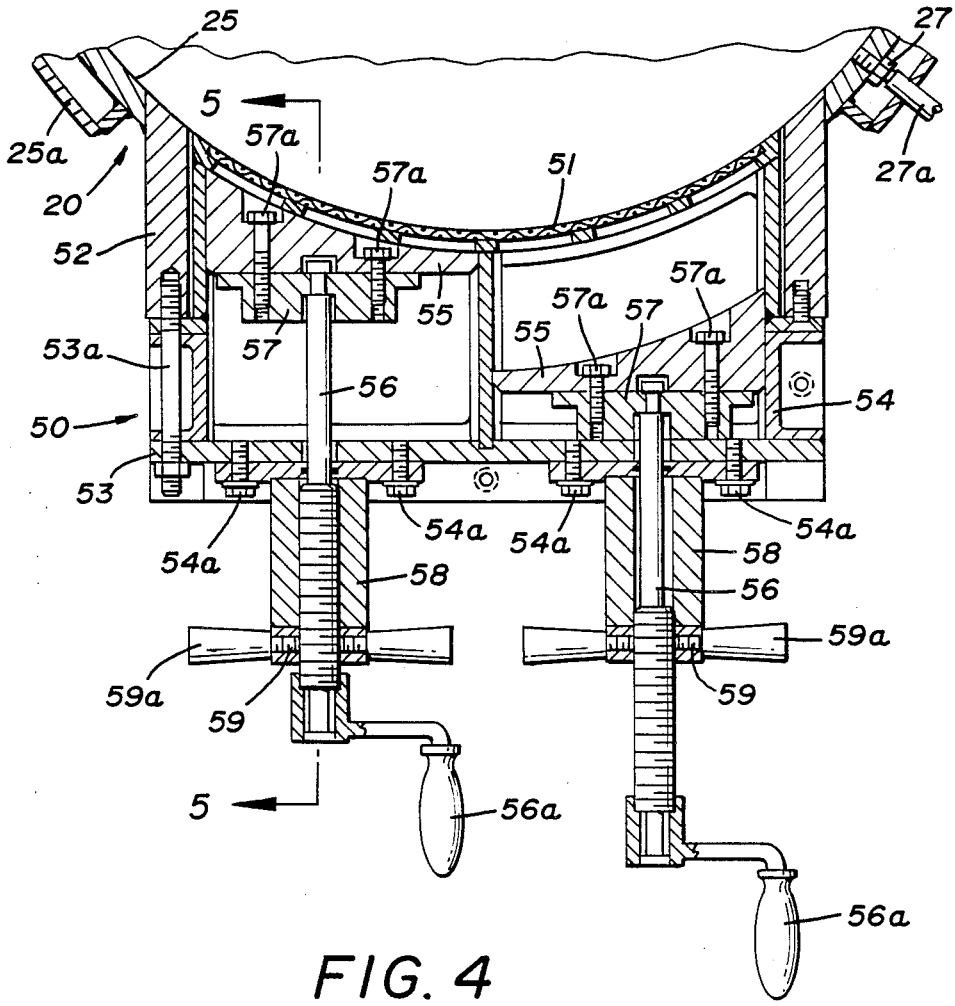
FIG. 4 is a horizontal sectional view of the discharge valve structure.
Figure 5:
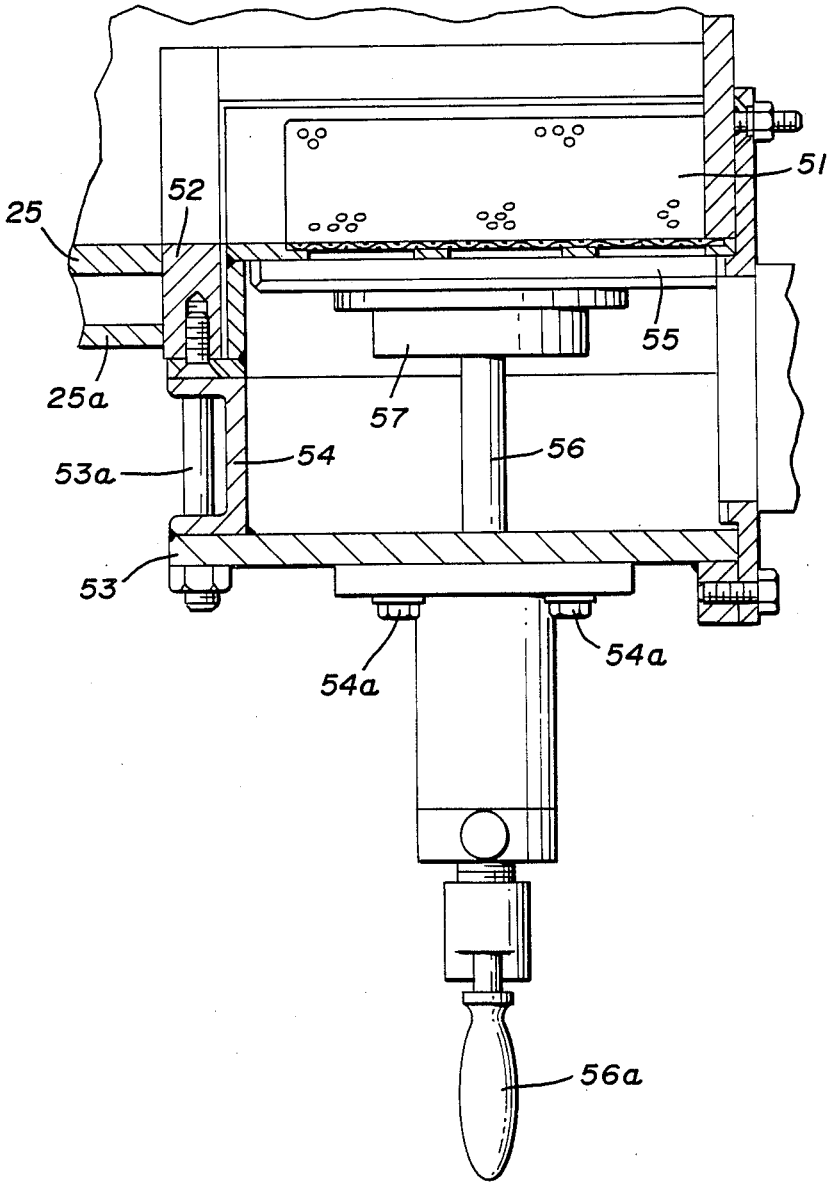
FIG. 5 is a sectional view of the discharge valve structure taken along the line 5—5 of FIG. 4.

Turning next then primarily to FIGS. 4 and 5 of the drawings for a description of a typical valve assembly 50, it will be noted that the discharge valve assembly 50 includes the previously mentioned screen 51 which is releasably mounted along the inside wall 25 of the comminuting vessel 20.

Mounted also on the wall 25 is a valve boss 52 which extends radially outwardly from the wall 25. A valve housing 53 is secured to the valve boss 52 by suitable threaded studs 53*a*, and a valve discharge 54 is also secured to the valve housing 53 by suitable screws 54*a* and terminates in discharge chutes 50*a*.

In the form of the invention illustrated, a four-valve system is shown and FIG. 4 illustrates a double valve on one side of the vessel 20, it being understood that a similar arrangement exists diametrically opposite. It will also be understood that more or less valves could be employed. The number of valves required will, to some extent, be dictated by the nature of the material. Thus, with material which is not particularly free flowing, more open screen area and thus more valving may be required.

Still referring to FIGS. 4 and 5, the illustrated valve includes valve plugs 55,55, each of which overlies a portion of screen 51 and each of which is attached to a valve stem 56 and ultimately to a handle 56*a*.

A bonnet 58 is mounted on and projects from the housing 53 and, in association with each valve, receives a valve stem 56. Each bonnet 58 has a radial bore for receipt of a lock nut 59 in each instance with the lock nut being actuated by a lock nut handle 59*a*.

A plug retainer 57 is secured to each of the plugs 55 by screws 57*a*,57*a*, and the valve stem 56 is affixed thereto so that, once the lock nut handle 59*a* is turned to release the lock nut 59, the handle 56*a* can be turned to move valve stem 56 axially and, thus, to move plug 55 either in or out of covering relationship with respect to a portion of the screen 51.

As can be seen in FIG. 4, the left-hand plug is all the way in, or in the closed position, thereby closing off that portion of the screen 51, while the plug on the right-hand side of FIG. 4 is extended outwardly, thereby opening that portion of the screen which it normally overlies and permitting the ground material to be forced out through the screen and through the opening 54*a* in discharge chute 54.

If desired, in order to improve the discharge rate, it is possible to inject air through fitting 27 from hose 27*a* just upstream of screen 51. This has the effect of fluidizing the ground material to thus make it less compact. Alternatively, an air knocker could be connected to the screen so as to vibrate it thus also facilitating discharge.

In operation, it will be assumed that the grinder will be assembled as shown in FIG. 1 of the drawings and that the diverter discs 44 and agitating arms 42 will have been secured to shaft 41 with the arms adjusted, as previously mentioned, with respect to the proximity of the short vertical legs 42*b* to the wall 25 of vessel 20. With agitator shaft 41 secured to the drive train and discharge valve assemblies 50 closed, the grinder is ready for receipt of the material to be ground through feed chute 18.

It should be noted here that the spacing of legs 42*b* from the inner wall 25 is usually determined by the size of the grinding elements and that the space will normally be from four to seven ball diameters. Also, the same spacing will be maintained between the lowermost agitating arm 42 and bottom wall 26.

Furthermore, desirable results can be obtained where the diameter of the diverter discs 44 is from about fifty percent (50%) to about eighty-three percent (83%) of the diameter of vessel 20.

In operation, it has been found that the combination of the L-shaped agitating arms 42 and the diverter discs 44 makes it possible to use smaller grinding media and to operate the grinder faster than is typically the case in a dry grinding operation.

For example, typically in dry grinding in a stirred ball mill, the grinding media are between ½ inch and 3/16 of an inch (12.7 mm–4.763 mm) whereas it has been found through experimentation that much reduced sizes of media can be employed, such as from ⅛ of an inch to 1/16 of an inch (3.175 mm–1.548 mm) or even as low as 1/32 of an inch.

Similarly, the normal speed at which the agitator shaft is rotated in a dry grinding operation is 300 to 350 rpms. That is with a 6.5 inch diameter arm. It has been found that by the present invention with a similar size arm, the rpms can be increased to a range of 1000 to 1700. It will be noted that the tip speed at the ends of the agitating arms is the critical criteria. However, it is common in the industry to state the speed in terms of shaft speed as has been done herein. However, proportionate tip speed increases are achieved on the order of three times. Other than the example given above, no absolute numbers are given since the absolute speeds will vary depending on the size of the apparatus.

Accordingly, the velocity is so great that the material has a tendency to form a straight cylinder during mixing, but the addition of the diverter discs 44 breaks this up and diverts some of the material flow to the areas between the discs to increase residence time in the grinding chamber which insures a finer grind.

It has also been found that when grinding fibrous materials, such as wood pulp, cotton seed, hay, etc., improved results are obtained. In prior art dry grinding processes, the fiber tends to mat against the wall. With the improved design, the fibers tend to shear off into small particles when they encounter the sidewall mounted screen 51.

Similar problems of matting are usually found with rubber or plastic and are also overcome in the present invention by the centrifugal discharge through the sidewall mounted screen. Also, the increased velocity of the grinding elements breaks up the polymeric particles without having to run at cryogenic temperatures so as to render the polymers brittle.

The advantages of the present invention may further be illustrated by the following non-limited examples.

EXAMPLE I

In this example, five pounds of calcium carbonate having an average original size of 14.88 microns; 90% at 27.6 microns was ground in a 1.5 gallon tank equipped with only L-shaped arms similar to agitating arm 42 and using grinding elements having a diameter of 3.175 mm. With a shaft speed of 500 rpm generated by a 3 HP motor, this produced a process rate of 15 lbs./hr. and a final size of ground particles of 83% less than 14.9 microns and 73% less than 10.5 microns.

Seven pounds of the same material having an identical original size was ground in a one gallon tank equipped with the combination of Applicant's L-shaped agitating arms 42 and diverter discs 44 and using grinding elements having a diameter of 1 mm. With a shaft speed of 1350 rpm generated by a 3 HP motor, this produced a process rate of 73 lbs./hr. and a final size of ground particles of 90% less than 14.1 microns; 83% less than 10.55 microns and 71% less than 7.46 microns.

Both tests were run on a continuous basis and the improved processing rate and finer grind clearly demonstrate the advantage of Applicant's process.

EXAMPLE II

In this example, 235 pounds of Talc having an original size of less than 325 mesh was ground in a 2.5 gallon tank equipped with only L-shaped agitating arms and using grinding elements having a diameter of 3.175 mm. With a shaft speed of 680 rpm generated by a 3 HP motor (contrary to the usual 300 to 350 rpm operating speed of the machine), this produced a process rate of 8.8 lbs./hr. and a final size of ground particles of a majority of less than 10 microns, some from 10 to 20 microns, and a few 25 microns.

Fifty pounds of the same material having an identical original size was ground in a one gallon tank equipped with the combination of Applicant's L-shaped agitating arms 42 and diverter discs 44 and using grinding elements of 3.175 mm. With a shaft speed of 1350 rpm generated by a 3 HP motor, this produced a production rate of 35.3 lbs./hr. and a final particle size of a majority of less than 10 microns, some from 20 to 25 microns and a few 30 microns.

Both tests were run on a continuous basis and, using comparable grinding elements, an equally fine grind was produced by Applicant's process at a much higher production rate.

EXAMPLE III

In this example, 750 grams of polymethyl methacrylate having an original size of 50 mesh was ground in a 1.5 gallon tank equipped only with straight agitating arms and using grinding elements having a diameter of 6.350 mm. With a shaft speed of 350 rpm generated by a 2 HP motor, this produced a production rate of 300 grams/hr. and a final particle size of a majority from 1 to 10 microns and some from 30 to 40 microns. It should be noted that this test was run on a "batch" basis since the processing time was 2.5 hours.

Five hundred grams of the same material having an identical original size was ground in a one gallon tank equipped with Applicant's combination of L-shaped arms 42 and diverter discs 44 and using grinding elements of 3.175 mm. With a shaft speed of 1700 rpm generated by a 3 HP motor, this produced a production rate of 167 grams/hr. and a final particle size of a majority of from 1 to 5 microns and some from 5 to 8 microns.

It should be noted that the control sample required the addition of liquid nitrogen to lower the temperature.

EXAMPLE IV

In this example, 700 grams of polyvinyl alcohol (PVA) having an original size of 20 mesh was ground in a 1.5 gallon tank equipped only with straight agitating arms and using grinding elements of 4.763 mm. With a shaft speed of 350 rpm generated by a 2 HP motor, this produced a production rate of 175 grams/hr. and a final particle size of 30% less than 100 mesh. It should be noted that this test was run on a "batch" basis since the processing time was four hours.

Two hundred grams of the same material having an identical original size was ground on a continuous basis in a one gallon tank equipped with Applicant's combination of L-shaped agitating arms 42 and diverter discs 44 and using grinding elements of 3.175 mm. With a shaft speed of 1000 rpm generated by a 3 HP motor, this produced a production rate of 13 lbs./hr. and a final particle size of 100% at less than 100 mesh.

While a full and complete description of the invention has been set forth in accordance with the dictates of the Patent Statutes, it should be understood that modifications can be resorted to without departing from the spirit hereof or the scope of the appended claims.

Thus, in some instances, a problem may occur with matting of the material in the upper portion of vessel 20. In that situation, at least the upper agitating arm 42 or the upper two arms can be rotated so that the short legs **42*b* project upwardly as shown in broken lines in FIG. 2**.

Also, in addition to the characteristics of the grinder which produce the improved operation achieved by this invention, it will be understood by those skilled in the art that the material being ground will dictate various factors such as the size and density of the grinding elements and the volume used as well as the feed rate of the material being ground. Similarly, the type of screen and the size and type of screen opening will be matters affecting operation.

Furthermore, while agitating arms 42 have been illustrated and described as L-shaped for ease of manufacture and assembly, other configurations could be employed so long as they provide agitating elements close to the walls of the vessel 20 as described above.

Finally, while agitating arms 42 are shown and described as spaced radially 90° for optimum balance, other spacing may be employed.

What is claimed is:

1. A continuous dry grinder for grinding of particulate material using grinding elements, comprising:

(a) a grinding vessel;

(b) access means disposed adjacent the top of said vessel;

(c) agitator means disposed within said vessel for rotational movement relatively thereof;

(d) discharge means disposed in the wall of said vessel adjacent the bottom thereof; and (e) said agitator means include an elongate shaft and a plurality of diverter discs and agitating arms attached to said shaft in vertically alternating relationship with each other;

(f) said agitating arms projecting radially from said shaft and having distal ends disposed substantially parallel to the wall of said grinding vessel.

2. The continuous dry grinder of claim 1 wherein said agitating arms are each generally L-shaped in elevation having a long leg and a short leg; said short leg having its axis disposed normally to the axis of said long leg; said short leg being disposed adjacent the inner wall surface of said vessel.

3. The continuous dry grinder of claim 2 wherein said agitating arms are adjustably attached to said agitator shaft whereby the proximity of said short legs thereof to the inner wall surface of said vessel may be altered.

4. The continuous dry grinder of claim 2 wherein said discs have a diameter of between about 50% to 83% the diameter of said vessel.

5. The continuous dry grinder of claim 1 or 2 wherein said agitating arms are spaced from the inner wall of said grinding vessel a distance from about four diameters of the grinding elements to about seven diameters of the grinding elements utilized.

6. The continuous dry grinder of claim 5 wherein the lowermost grinding arm is spaced from the bottom wall of said vessel a distance from about four diameters of the grinding elements to about seven diameters of the grinding elements utilized.

7. The continuous dry grinder of claim 2 wherein said agitating arms are disposed in alternating fashion with each successive arm being disposed radially substantially 90° with respect to its successor.

8. The continuous dry grinder of claim 7 wherein said agitating arms are disposed with said short legs extending alternately directed toward the top and bottom of said vessel.

9. The continuous dry grinder of claim 8 wherein at least the uppermost two of said agitating arms are disposed with said short legs directed toward the top of said vessel.

10. The continuous dry grinder of claim 1 wherein said diverter discs and said agitating arms are attached to said shaft so as to preclude movement along the longitudinal axis of said agitator shaft.

11. The continuous dry grinder of claim 1 wherein said discharge means include a screen mounted in the wall of said vessel; and at least one valve adjustable between covering and uncovering relationship with said screen.

12. The continuous dry grinder of claim 11 wherein said discharge means include a discharge chute connected to said valve means.

13. The continuous dry grinder of claim 11 wherein means are disposed adjacent said screen for creating increased agitation of the material as it is forced through said screen.

14. The continuous dry grinder of claim 11 wherein means are provided on said grinding vessel for supplying air to the interior thereof; said means being disposed adjacent said screen of said discharge means whereby the material is fluidized for discharge through said screen.

15. A continuous dry grinder for grinding particulate material using grinding elements, comprising:

(a) a power source;
(b) a grinding vessel having access means disposed adjacent the top thereof;
(c) agitating means disposed within said vessel and operatively connected to said power source;
(d) discharge means disposed on the wall of said vessel adjacent the bottom thereof; and
(e) said agitating means including
  (1) an elongate agitator shaft,
  (2) a plurality of L-shaped agitating arms attached to said agitating shaft and projecting radially therefrom, and
  (3) a series of diverter discs mounted on said agitator shaft in axially alternating relationship with said L-shaped arms.

16. A continuous dry grinder for grinding particulate material, comprising:

(a) a grinding vessel;
(b) access means disposed adjacent the top of said vessel;
(c) agitator means disposed within said vessel for rotational movement relatively thereof;
(d) discharge means disposed in the wall of said vessel adjacent the bottom thereof;
(e) said agitator means including an elongate shaft and a plurality of diverter discs and agitating arms attached to said shaft in vertically alternating relationship therewith;
(f) said agitating arms projecting radially from said shaft and having distal ends disposed substantially parallel to the wall of said grinding vessel; and
(g) a quantity of grinding elements disposed within said grinding vessel and having a diameter from about ⅛ inch to about 1/32 inch.

17. A continuous dry grinder for grinding of particulate material using grinding elements, comprising:

(a) a grinding vessel;
(b) access means disposed adjacent the top of said vessel;
(c) agitator means disposed within said vessel for rotational movement relatively thereof;
(d) discharge means disposed in the wall of said vessel adjacent the bottom thereof;
(e) said agitator means including an elongate shaft and at least one diverter disc and agitating arm attached to said shaft; and
(f) said agitating arm being generally L-shaped in elevation and having a long leg and a short leg; said short leg having its axis disposed normally to the axis of said long leg; said short leg being disposed adjacent the inner wall surface of said vessel.

18. The continuous dry grinder of claim 17 wherein said agitating arm is adjustably attached to said agitator shaft whereby the proximity of said short leg thereof to the inner wall surface of said vessel may be altered.

19. The continuous dry grinder of claim 17 wherein said discharge means include a screen mounted in the wall of said vessel; and at least one valve adjustable between covering and uncovering relationship with said screen.

20. The continuous dry grinder of claim 17 wherein said discharge means include a discharge chute connected to said valve.

21. The continuous dry grinder of claim 17 wherein said diverter disc has a diameter equal to between about 50% to 83% of the internal diameter of said vessel.

22. The continuous dry grinder of claim 17 wherein a plurality of agitating arms are attached to said shaft; and said agitating arms are disposed in alternating fashion with each successive arm being disposed radially substantially 90° with respect to its successor.

23. The continuous dry grinder of claim 22 wherein said agitating arms are disposed with said short legs extending alternately directed toward the top and bottom of said vessel.

24. The continuous dry grinder of claim 23 wherein at least the uppermost two of said agitating arms are disposed with said short legs directed toward the top of said vessel.

* * * * *